US007490876B2

(12) United States Patent
Kihara

(10) Patent No.: US 7,490,876 B2
(45) Date of Patent: Feb. 17, 2009

(54) FASTENER FOR BAG

(75) Inventor: Minoru Kihara, Tokyo (JP)

(73) Assignee: Daito Company Limited, Tokyo (JP)

( * ) Notice: Subject to any disclaimer, the term of this patent is extended or adjusted under 35 U.S.C. 154(b) by 187 days.

(21) Appl. No.: 10/764,441

(22) Filed: Jan. 27, 2004

(65) Prior Publication Data

US 2004/0183317 A1 Sep. 23, 2004

(30) Foreign Application Priority Data

Feb. 7, 2003 (JP) ..... 2003-030284

(51) Int. Cl.
*E05B 15/12* (2006.01)

(52) U.S. Cl. ..... 292/341.12; 292/DIG. 48; 292/DIG. 50

(58) Field of Classification Search ..... 292/DIG. 48, 292/DIG. 50, 341.12
See application file for complete search history.

(56) References Cited

U.S. PATENT DOCUMENTS

| | | | | |
|---|---|---|---|---|
| 1,590,400 | A * | 6/1926 | Widmer | 292/80 |
| 1,702,621 | A * | 2/1929 | Stelljes | 292/334 |
| 4,466,645 | A | 8/1984 | Kobayashi | |
| 4,981,313 | A | 1/1991 | Makamura | |
| 2003/0090114 | A1 * | 5/2003 | Kang | 292/340 |

FOREIGN PATENT DOCUMENTS

| | | |
|---|---|---|
| CN | 1104079 A | 6/1995 |
| CN | 1087157 C | 7/2002 |
| JP | 49-2703 | 4/1972 |
| JP | 58-126023 | 8/1983 |
| JP | 62-24721 | 2/1987 |
| JP | 7-24104 | 5/1995 |
| JP | 3014935 | 6/1995 |
| JP | 8-196324 | 8/1996 |
| JP | 8-333939 | 12/1996 |
| KR | 1996-0006282 | 7/1996 |

* cited by examiner

*Primary Examiner*—Gary Estremsky
(74) *Attorney, Agent, or Firm*—Oblon, Spivak, McClelland, Maier & Neustadt, P.C.

(57) ABSTRACT

A fastener for bags includes an engaging piece (12) fixed on a lid (11) side of a bag and a latch mechanism (19) fixed on a main body (13) side of the bag and adapted to admit the engaging piece detachably. Since part of the engaging piece is clad with a member (15) for preventing infliction of injury, the lid in the process of being opened or closed has no possibility of inflicting any injury on a metallic surface (28) disposed on the latch mechanism side. Thus, the metallic surface can always be kept beautiful.

6 Claims, 3 Drawing Sheets

FASTENER FOR BAG

BACKGROUND OF THE INVENTION

1. Field of the Invention

This invention relates to a fastener for briefcases, bags, etc. and more particularly to a fastener for bags which prevents an engaging piece on the lid side thereof from inflicting a scar or a dent on a latch mechanism on the main body side thereof as a consequence of collision between the engaging piece and the latch mechanism while the fastener is in the process of being opened and closed.

2. Description of the Prior Art

Heretofore, it has been proposed to have the surface of a fitting for a women's handbag coated and formed with nitride or carbide of titanium (Ti) as disclosed in Japanese Utility Model Registration No. 3038616. It has been customary to produce this fitting by evaporating titanium in accordance with a method of physical vacuum deposition on a metallic fitting molded in advance in a shape proper for the function expected to be discharged so as to enable the produced fitting to excel in corrosion resistance and wear resistance.

Since the fitting has a thin coating layer of titanium, however, it has been at a disadvantage in being easily injured and eventually peeled when the metal used as the body material thereof is deficient in hardness. It has further suffered from the defect of incurring a high production cost because it requires the whole surface thereof to be coated with titanium by ionic plating. The fitting as a finished product has not been allowed to assume any color arbitrarily chosen.

This invention has been proposed in view of the true state of affairs mentioned above and is aimed at providing a fastener for bags which exhibits an excellent ability to resist infliction of injury.

SUMMARY OF THE INVENTION

For the purpose of attaining the aim mentioned above, this invention is directed toward a fastener for bags, comprising an engaging piece fixed on a lid side of a bag and a latch mechanism fixed on a main body side of the bag and adapted to admit the engaging piece detachably, with part of the engaging piece clad with a member for preventing infliction of injury.

In the fastener according to this invention, the engaging piece embraces the requirement that it be furnished with an engaging ring for taking in a latch member of the latch mechanism.

In the fastener according to this invention, the member for preventing infliction of injury embraces the requirement that at least part of the engaging piece be coated with synthetic resin, or at least part of the engaging piece have synthetic resin adhere thereto, or at least part of the engaging piece have synthetic resin fitted therein, or the engaging piece and a synthetic resin piece be joined fast with a cementing member.

Since the fastener for briefcases, bags, etc. according to this invention has part of the engaging piece coated with a member for preventing infliction of injury, the metallic surface against which the engaging piece is fated to collide while the lid of a briefcase, bag, etc. is in the process of being opened and closed has no possibility of sustaining a scar or a dent. The surface of the fastener for the briefcases, bags, etc., therefore, can always be kept beautifully.

Furthermore, since the engaging piece of the fastener for bags, etc. according to this invention is furnished with an engaging ring for taking in the latch member of the latch mechanism, it is not required to be provided with a projecting part and, therefore, has no possibility of inflicting a scar on the metallic surface.

The above and other objects and the other characteristic features of this invention will become apparent from the following detailed description of the invention that is based on the drawing annexed hereto.

DESCRIPTION OF THE PREFERRED EMBODIMENT

Figure 1:
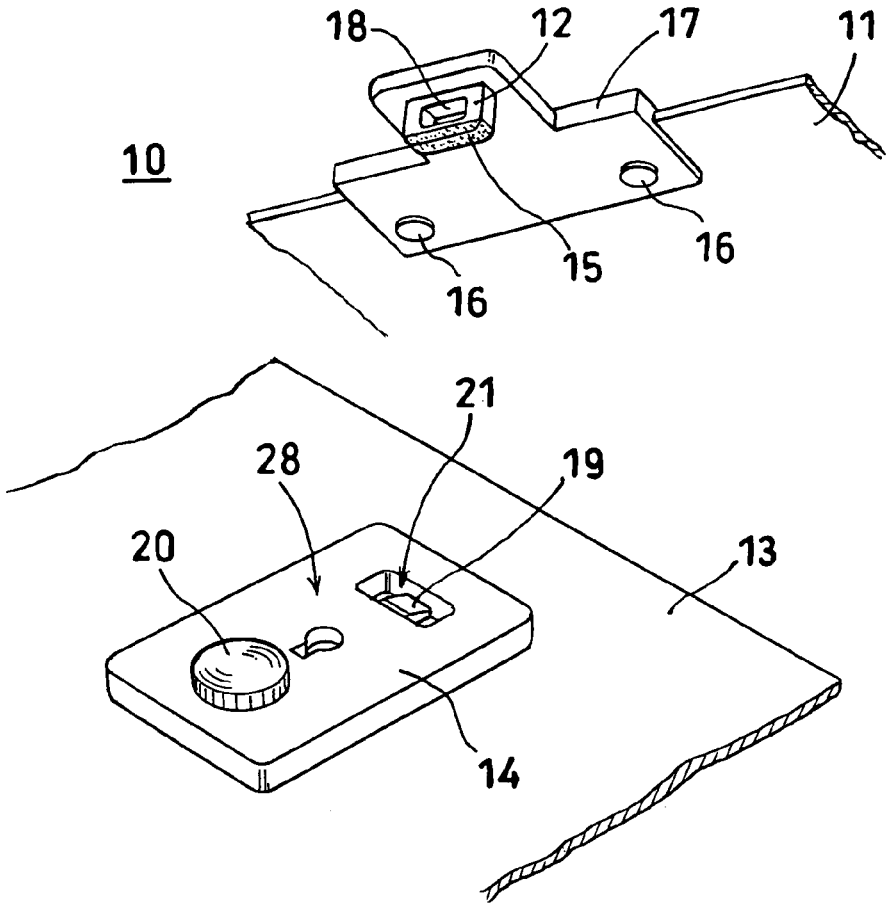
FIG. 1 is a perspective view of essential part illustrating one embodiment of a fastener for bags, etc. according to this invention.
Figure 2:
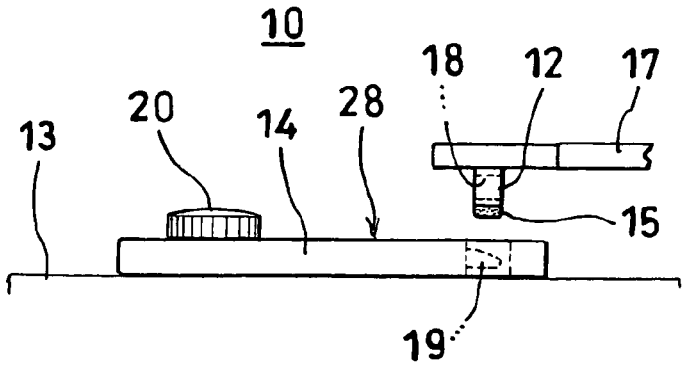
FIG. 2 is a side view of the essential part of the fastener for bags, etc. which is shown in FIG. 1.

One embodiment of the fastener for bags, etc. according to this invention will be described in detail below with reference to the attached drawing. FIGS. 1 and 2 illustrate one embodiment of the fastener for bags, etc. according to this invention. A fastener 10 is for bags, etc. and comprises an engaging piece 12 fixed on a lid side 11 of a bag and a latch mechanism 14 fixed on a main body side 13 of the bag and adapted to admit therein the engaging piece 12 detachably, with part of the engaging piece 12 clad with a member 15 for preventing infliction of scar.

In the present embodiment, the engaging piece 12 is fixed substantially at a right angle as directed toward the main body side 13 to the distal end side of a holding member 17 fixed with screws 16 to the end face of a lid side 11. Furthermore, in this embodiment, the engaging piece 12 is provided with an engaging ring 18 for taking in a latch member 19 of the latch mechanism 14. Optionally, the engaging piece may be in a form devoid of the engaging ring 18. The latch member 19 is resiliently energized with a spring mechanism (not shown) so as to be thrust into a depressed part 21 of the latch mechanism 14 for admitting the engaging piece 12 and is adapted to be retracted against the spring by the manipulation of a knob 20 of the latch mechanism 20.

Figure 3:
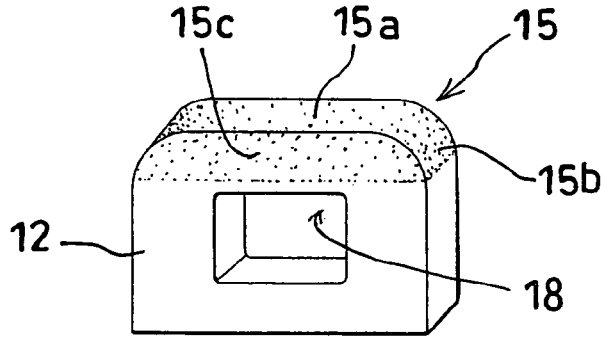
FIG. 3 is a perspective view illustrating the first embodiment of the engaging piece to be used in the fastener for bags, etc.

The member 15 for preventing infliction of injury is formed through coating the surface of the engaging piece 12 with a layer of synthetic resin in a prescribed thickness as illustrated in FIG. 3. The surface for this coating comprises a surface 15*a* fated to collide against the latch mechanism 14, a surface 15*b* continuing thereto, and opposite lateral surfaces 15*c*. As concrete examples of the synthetic resin to be used advantageously for this coating, polyethylene, nylon, saponified EVA, epoxy, polyester, fluorine resin, PTFE, FEP, and PFA may be cited.

When the fastener is constructed as described above, since the surface of the engaging piece 12 colliding against the latch mechanism 14 is coated with the layer of synthetic resin, a metallic surface 28 of the latch mechanism 14 cannot be injured but can always be kept beautiful.

Figure 4:
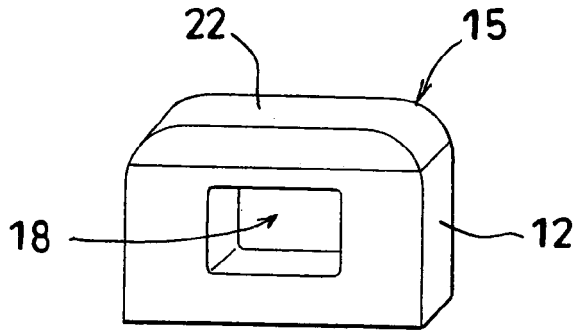
FIG. 4 is a perspective view illustrating the second embodiment of the engaging piece to be used in the fastener for bags, etc.

FIG. 4 is a perspective view illustrating the second embodiment of the engaging piece to be used in the fastener for bags according to this invention. In this embodiment, the member 15 for preventing infliction of injury is a piece of synthetic resin 22 applied fast to the surface in part of the engaging piece 12 confronting the latch mechanism 14 by means of adhesion. The synthetic resin used herein may be any of the synthetic resins enumerated above by way of illustration.

When the fastener is thus constructed, since the surface of the engaging piece 12 colliding against the latch mechanism 14 is formed of the synthetic resin, the metallic surface 18 of the latch mechanism 14 cannot sustain a scratch or an injury but can always be kept beautiful.

Figure 5:
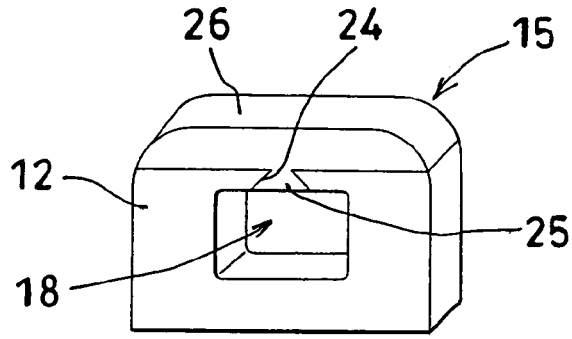
FIG. 5 is a perspective view illustrating the third embodiment of the engaging piece to be used in the fastener for bags, etc.

FIG. 5 is a perspective view illustrating the third embodiment of the engaging piece to be used in the fastener for bags, etc. In the present embodiment, a dovetail groove 14 formed in part of the engaging piece 12 and a projection 25 provided on a piece of synthetic resin 26 and adapted to conform to the dovetail groove 24 are joined by means of insertion-setting.

When the fastener is constructed as described above, the dovetail groove 24 enables the piece of synthetic resin 26 to be fixed infallibly to the engaging piece 12. Thus, the piece of synthetic resin can be prevented from accidental fall.

Figure 6:
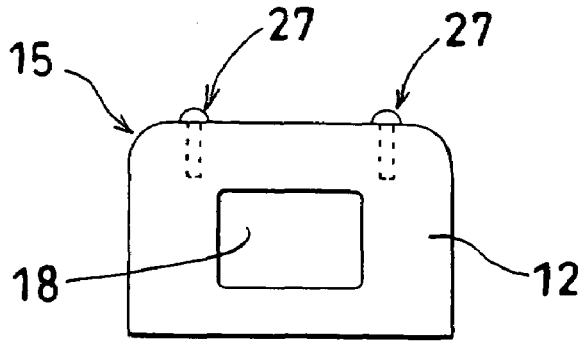
FIG. 6 is a front view illustrating the fourth embodiment of the engaging piece to be used in the fastener for bags, etc.

FIG. 6 is a front view illustrating the fourth embodiment of the engaging piece to be used in the fastener for bags, etc. In this embodiment, the member 15 for preventing infliction of injury is formed through insertion of screws 27 made of synthetic resin into part of the engaging piece 12. In the present embodiment, insertion of two screws is depicted. The number of screws to be used for the insertion does not need to be limited to two but may be changed to one or to three or more as occasion demands.

When the fastener is thus constructed, a simple structure suffices to prevent the opposed metallic pieces from colliding with each other and sustaining injuries.

Figure 7:
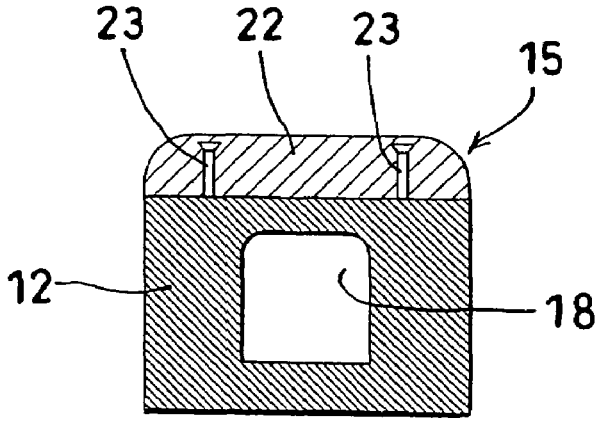
FIG. 7 is a longitudinal section illustrating the fifth embodiment of the engaging piece to be used in the fastener for bags, etc.

FIG. 7 is a longitudinal section illustrating the fifth embodiment of the engaging piece to be used in the fastener for bags according to this invention. In the present embodiment, the member 15 for preventing infliction of injury relies on fixing pins (joining members) 23 erected in part of the engaging piece 12 to fix the piece of synthetic resin 22. The synthetic resin to be used herein may be any of the synthetic resins enumerated above.

When the fastener is constructed as described above, since the piece of synthetic resin 22 is fixed with the fixing pin 23, the piece of synthetic resin can be fixed more infallibly. The otherwise possible fall of the piece of synthetic resin due to a shock, therefore, can be precluded.

This invention does not need to be limited to the embodiments described above but may be given variously design changes without departure from the technical scope of this invention.

Since this invention is constructed as described above, it can manifest such effects as described herein below.

This invention concerns a fastener for bags, etc. which is formed of an engaging piece fixed on the lid side of a bag and a latch mechanism fixed on the main body side of the bag and adapted to admit the engaging piece detachably as described above. Since it has part of the engaging piece clad with a member for preventing infliction of injury, the metallic surface of the latch mechanism that is destined to collide against the engaging piece when the lid of the bag is in the process of being opened and closed cannot be injured or dented. The metallic surface of the latch mechanism, therefore, can always be kept beautiful.

The engaging piece of the fastener according to this invention is provided with the engaging ring for admitting the latch member of the latch mechanism. Since the engaging piece is no longer required to be provided with a projecting part, therefore, the possibility of the engaging piece inflicting injury on the metallic surface of the latch mechanism is remote. Furthermore, since the member for preventing infliction of injury has the synthetic resin fastened to the engaging piece by means of application, adhesion, or insertion-setting, the opposed metallic pieces are not suffered to collide against each other and the metallic surface of the latch mechanism is not injured.

What is claimed is:

1. A fastener mounted on a bag, comprising:

an engaging piece fixed on a lid portion of the bag and a latch mechanism comprising a metallic surface and a latch member, wherein the latch mechanism comprises a single latch fixed on an outer surface side of a main body of the bag and which is oriented so as to be substantially parallel to said outer surface of said main body portion of the bag and which is configured to detachably admit therein the engaging piece, wherein the engaging piece comprises a single engaging ring configured for admitting the latch member and for engaging the metallic surface wherein said engaging piece is clad with a synthetic resin member configured for preventing infliction of injury to the metallic surface, and a one piece holding member having a portion thereof extending therefrom, said engaging ring being mounted on said extended portion of said holding member so as to be spaced from an edge portion of the lid and said holding member being oriented substantially parallel to the lid portion of the bag, said engaging ring projecting substantially perpendicularly from said holding member wherein said holding member is connected exclusively to the lid portion of the bag in proximity with said latch mechanism, said engaging ring being directed towards an interior portion of the bag.

2. A fastener according to claim 1, wherein said latch mechanism is located on an outer surface of the bag.

3. A fastener according to claim 2, which further comprises a release mechanism to release the engaging piece from the latch mechanism, said release mechanism being mounted on said latch mechanism wherein said metallic surface is located on an upper surface of said latch mechanism.

4. A fastener according to claim 1 wherein, upon locking of said engaging ring with said latch mechanism, said holding member and said lid portion are positioned in a same plane as said latch mechanism so as to be aligned therewith.

5. A fastener according to claim 1, wherein a width dimension of said extended portion is substantially equal to a width dimension of said latch mechanism.

6. A fastener according to claim 4, wherein a width dimension of said extended portion is substantially equal to a width dimension of said latch mechanism.

* * * * *